US011545006B2

(12) United States Patent
Jackson

(10) Patent No.: US 11,545,006 B2
(45) Date of Patent: Jan. 3, 2023

(54) HORSE RACING CASINO GAME

(71) Applicant: Harry Jackson, Binghamton, NY (US)

(72) Inventor: Harry Jackson, Binghamton, NY (US)

(73) Assignee: Harry Jackson, Binghamton, NY (US)

( * ) Notice: Subject to any disclaimer, the term of this patent is extended or adjusted under 35 U.S.C. 154(b) by 0 days.

(21) Appl. No.: 16/974,154

(22) Filed: Oct. 22, 2020

(65) Prior Publication Data

US 2022/0130213 A1 Apr. 28, 2022

(51) Int. Cl.
*G07F 17/32* (2006.01)

(52) U.S. Cl.
CPC ..... *G07F 17/3288* (2013.01); *G07F 17/326* (2013.01); *G07F 17/3211* (2013.01)

(58) Field of Classification Search
CPC . G07F 17/3288; G07F 17/3211; G07F 17/326
USPC ..... 463/6
See application file for complete search history.

(56) References Cited

U.S. PATENT DOCUMENTS 3,951,412 A * 4/1976 Adams ..... A63F 3/00082 273/246
4,033,587 A * 7/1977 Oliver ..... A63F 1/04 273/246
6,120,376 A 9/2000 Cherry
6,210,275 B1 * 4/2001 Olsen ..... G07F 17/32 273/138.1
7,566,268 B2 7/2009 Asher
9,418,517 B1 8/2016 Davis
9,449,464 B2 * 9/2016 Nicely ..... G07F 17/326
2001/0008845 A1 * 7/2001 Kusuda ..... G07F 17/3244 463/25
2003/0020235 A1 1/2003 Brenner
2020/0197787 A1 6/2020 Jackson

OTHER PUBLICATIONS

"Daily Double and Pick 3 Horse Racing Betting", SportsGeek, published to Internet on Sep. 9, 2015, retrieved from Internet via Internet Wayback Machine from URL<https://web.archive.org/web/20150909093205/https://www.thesportsgeek.com/sports-betting/horse-racing/daily-double-pick-3/>. (Year: 2015).*

* cited by examiner

*Primary Examiner* — Jay Trent Liddle
*Assistant Examiner* — Ryan Hsu
(74) *Attorney, Agent, or Firm* — Vedder Price P.C.

(57) ABSTRACT

A casino game having a horse-racing theme. The casino game encompasses several playable races. A horseshoe playing surface is provided, which has a plurality of horse positions and a betting area inscribed thereon.

20 Claims, 6 Drawing Sheets

HORSE RACING CASINO GAME

RELATED PATENT APPLICATIONS

The present application is a continuation-in-part application of co-pending U.S. patent application Ser. No. 16/226,623, filed Dec. 19, 2018, for CASINO DERBY, which was related to provisional patent application for HORSE RACING CASINO GAME, application No. 62/608,235, filed Dec. 20, 2017, and hereby incorporates the teaching of both applications by reference.

FIELD OF THE INVENTION

The present invention pertains to casino games and, more particularly, to a casino game including provision for players to bet on horses in a simulated horse race, playing position markers representing racing horses, and means for wagering.

BACKGROUND OF THE INVENTION

The competitive racing of horses is one of humankind's most ancient sports, having its origins among the prehistoric nomadic tribesmen of Central Asia who first domesticated the horse some 6,000 years ago. For thousands of years, horse racing flourished as the sport of kings and nobility.

Horse racing is the second most widely attended U.S. spectator sport, after baseball. Horse racing is also a major professional sport in Canada, Great Britain, Ireland, Western Europe, the Middle East, Australia, New Zealand, South Africa, and South America.

By the time humans began to keep written records, horse racing was an organized sport in all major civilizations from Central Asia to the Mediterranean. Both chariot and mounted horse racing were events in the ancient Greek Olympics, and the sport was popular in the Roman Empire.

Horse racing began to become a professional sport during the reign of Queen Anne in the early $18^{th}$ century, when match racing gave way to races involving several horses on which spectators wagered. Racecourses were built all over England, offering increasingly large purses to attract the best horses. These purses in turn made breeding and owning horses for racing profitable.

British settlers brought horses and horse racing to the New World, with the first racetrack laid out on Long Island in the $17^{th}$ century. Gambling on racehorses grew significantly over time. By 1890, more than 300 tracks were operating across the United States. Thoroughbred tracks now exist in half of the states in the United States. Public interest in the sport focuses primarily on major thoroughbred races such as the American Triple Crown and the Breeder's Cup races, which offer purses of up to $1,000,000.

Wagering on the outcome of horse races helps explain why horse racing has survived as a major professional sport. A major reason for the popularity of horse racing is the provision generally made for betting or wagering on the outcome of such races.

At racetracks, bettors may wager on a horse to win (finish first), place (finish first or second), or show (finish first, second, or third). Other popular wagers are the daily double (picking the winners of two consecutive races), exactas (picking the first and second horses in order), quinellas (picking the first and second horses in either order), and the pick six (picking the winners of six consecutive races). As horse racing and wagering on such races have become more popular, various refinements of the rules of betting (exactas, trifectas, odds, etc.) have evolved.

It is only logical that major gambling establishments, such as casinos, would have a connection to horse racing. In fact, many casinos are associated with racetracks. Thus, there is a great following in the casino industry of placing bets on horses.

DESCRIPTION OF RELATED ART

U.S. Pat. No. 3,690,666 issued to Seitz on Sep. 12, 1972 for HORSE RACING BOARD GAME APPARATUS describes a horse racing game including a game board inscribed with a simulated racetrack, and a plurality of cards inscribed with various groups of numbers which indicate horse performance, a particular horse's rating, key numbers, and index numbers. A race action board has various tables and charts which are used, in combination with the horse performance cards, to determine the amount each marker representing a horse is to be moved along the simulated racetrack. A random number selector is used to determine the key numbers and various finder numbers which are used with a plurality of finder tables which are, in turn, used to determine the track condition, race time, odds for each horse, etc. A race charting sheet is used to record all pertinent data during the preparation for and running of each race.

U.S. Pat. No. 4,060,246 issued to Ward on Nov. 29, 1977 for HORSE-RACE-SIMULATING PARLOR OR CASINO GAME OF PURE CHANCE describes a horse-race-simulating parlor, casino or the like game of pure chance, comprising a combination of a pair of dice which can be rolled to eleven numbers, from 2 to 12, and a play-board having thereon eleven play-numbers, from 2 through 12, representing eleven horses, and a finish-number which is the lowest common multiple of the numbers 1, 2, 3, 4, 5, and 6, representing ways in which said eleven horse-numbers can be rolled by the or is a multiple of such lowest-common-multiple, and having a chance-equalizing number for each play-number or horse-number, which chance-equalizing number is the lowest-common-multiple divided by the number of ways the play-number can be rolled by the dice.

U.S. Pat. No. 5,226,655 issued to Rickabaugh on Jul. 19, 1993 for APPARATUS AND METHOD OF PLAYING A BOARD GAME SIMULATING HORSE RACING AND WAGERING describes a board game that simulates the sport of horse racing and further allows players of the game to place wagers simulating on-track betting. The game includes a game board having a racecourse and infield, player position markers simulating racing horses, simulated money, betting tickets, chips, and chance and odds cards. The course is divided into a series of concentric tracks with each track being occupied by a corresponding marker during a race. Players place bets using the simulated money and receive betting tickets and chips according to their bets; the chips are placed in corresponding areas of an infield portion of the board. The player position markers are advanced according to or other chance determination, and moves are further modified in accordance with any chance cards which come into effect in the course of play. Odds cards may also change the odds during the course of the race. The first three markers are assigned win, place, and show positions and players win or lose according to their bets made prior to the race. Two or more players or teams may play, and provision is made to cause all player position markers to be played regardless of the number of actual players or teams. The game preferably comprises a series of races, with the player accruing the greatest winnings from his or her bets being the winner.

U.S. Pat. No. 5,795,226 issued to Yi on Aug. 18, 1998 for BETTING RACE GAME describes a device and method of playing a gaming game-simulating horse race which allows betting on a race already started. It comprises a playing surface with a race-course, means for displaying odds and results, means for generating random numbers to determine the progress of a race, means for self-service wagering, probability formulas and computer programs to calculate odds determined by the nature of a race and to display them, computer programs to calculate possible payoffs, and official results that can be displayed.

U.S. Pat. No. 5,839,726 issued to Luise on Nov. 24, 1998 for CASINO TABLE GAME describes a dice game having a horse-racing theme which includes a number of horses in the race, the number of which corresponds to the number of sides of a single die. In play, preferably three dice are used. When a number representing a horse is rolled by any of the dice, that horse is moved a distance referred to as a "furlong." If the horse's number appears on more than one die in a single roll, then the horse is moved a comparable number of furlongs. The game provides for standard horse racing wagers on the eventual outcome of the race, such as win, place, and show. The game further provides for a series of wagers, referred to as "betting-in-running," which can be placed on the outcome of each roll of the dice.

U.S. Pat. No. 5,853,173 issued to Murphy on Dec. 29, 1998 for NIGHT AT THE RACES BOARD GAME describes a playing board having a plurality of slots formed therein in an oval configuration. The plurality of slots forms a plurality of lanes. The plurality of slots is separated into twelve lengths. One of the twelve lengths signifies a starting point and a finishing point and being so indicated by indicia relative thereto. A plurality of playing pieces resembles a racehorse. Each of the playing pieces is designated by a number. Each of the playing pieces has a flat lower portion adapted for positioning within the slots of the playing board. A plurality of action cards each details a move made by the plurality of playing pieces around the playing board.

U.S. Pat. No. 6,120,376 issued to Cherry on Sep. 19, 2000 for WAGERING GAME BASED ON RANKING ORDER OF GAME PARTICIPANTS describes a wagering game for play by a player including a set of game participants, an identification number assigned to each of the game participants, and a game number. The player places a wager relating to the game number, and a ranking order of the game participants is determined, such as by a race to a finishing point. The sum of the identification numbers of a subset of the game participants may be calculated. The number of lengths by which a first ordered game participant beats another ordered game participant to the finishing point may also be calculated. Whether the player's wager is a winning wager is determined by comparing the sum or the number of lengths to the game number. The wagering game may be implemented as an electronic game.

United States Published Patent Application No. 2003/0020235 on an application by Brenner published on Jan. 30, 2003 for POKER GAME USING TOSSED BALLS describes a poker game using a playing surface for placing wagers that correspond to player selected poker hands. A plurality of balls is tossed into a hopper that directs the tossed balls to a surface that has a plurality of card positions. Each of the card positions is adapted to receive and retain a tossed ball and represent the playing cards of a poker deck and a joker. The card positions indicate cards that are selected by operation of the players tossing balls into the hopper and having the tossed balls being retained in the card positions.

U.S. Pat. No. 7,566,268 issued to Asher, et al. on Jul. 28, 2009 for ROULETTE GAME BASED ON RESULTS FROM A SPORTING EVENT describes an input, such as a result of a roulette spin, to a roulette game determined from one or more event results from a sporting event. A result of the roulette game is based at least on the determined input.

U.S. Pat. No. 9,418,517 issued to Davis on Aug. 16, 2016 for BALL RACE WAGERING GAME APPARATUS AND METHODS OF USE describes a rolling ball-race betting apparatus that has at least two decline planes with deflectors to allow balls to race down along the decline planes into a collector. A person may place any number of different types of wagers on a race result, such as selecting one ball to win. Each ball in the ball-race apparatus has a designation such as a number, symbol, color, or other marking. A ball-race apparatus may have stops, wherein one or more of the balls may be trapped in the stop and will not finish the race. A person may place a wager on one or more balls to not finish the race. A ball-race apparatus may have a shortcut conduit that transfers balls from the first decline plane to the second decline plane. A ball race game apparatus may include a spinning deflector that is configured to hit and propel the balls in any number of directions.

One of the objects of the present invention is to provide a casino game that allows players to bet on simulated horse races.

Another of the objects of the present invention is to provide a casino game which provides chance means for the advance of position markers, which position markers represent horses on a track.

Yet another of the objects of the present invention is to provide a casino game including means for betting or wagering on the outcome of the game.

An additional object of the present invention is to provide a casino game in which the number of players is variable.

With these and other objects in view which will more readily appear as the nature of the invention is better understood, the invention consists in the novel combination and arrangement of parts hereinafter more fully described, illustrated and claimed with reference being made to the attached drawings.

SUMMARY OF THE INVENTION

The present invention is a casino game having a horse-racing theme. The casino game encompasses several playable races. A horseshoe playing surface is provided, which has a plurality of horse positions and a betting area inscribed thereon. The inventive casino game uses a mechanical apparatus to simulate horse races. Players make wagers using gaming tables, electronic kiosks, betting windows, or other methods. The wagers are based on the positions three balls settle in after falling down a ball holding apparatus from a release point at the top. There are 14 final positions at the bottom of the device, numbered 0 through 13, and 14 corresponding release points at the top of the device. The balls are color-coded (Green=WIN; Yellow=PLACE; Black=SHOW), and the device prevents two balls from ending up in the same position, so that their landing positions can correspond to the first place, second place, and third place horses in the race.

In addition to the 14 drop positions, balls may be released in any order, giving a total of $3\times2\times1\times14=84$ possible ways to generate the outcomes. Players may wager on individual horses to win, place, or show, or on two or three horses at a time in exacta, trifecta, box 2, and box 3 bets. A table layout illustrated in FIG. 1 indicates possible values for the total sum value given by adding the numbers of the final positions for all 3 horses, and players may bet on these numbers or various combinations of them. The total sum values range from 0+1+2=3 to 11+12+13=36.

BRIEF DESCRIPTION OF THE DRAWING

A complete understanding of the present invention may be obtained by reference to the accompanying drawing, when considered in conjunction with the subsequent detailed description, in which.

Similar reference characters denote corresponding features consistently throughout the several figures of the attached drawings.

DETAILED DESCRIPTION OF THE PREFERRED EMBODIMENT

Although the following detailed description contains specific details for the purposes of illustration, those of ordinary skill in the art will appreciate that variations and alterations to the following details are within the scope of the invention. Accordingly, the exemplary embodiments of the invention described below are set forth without any loss of generality to, and without imposing limitations upon, the claimed invention. The terms "horse" and "horses," for example, are intended to include all creatures, real and fantastical, including, for instance, dragons.

In accordance with the invention, there is provided a casino game having a horse-racing theme. It should be understood that the invention is not necessarily limited to horse racing; other creatures, both real and fantastical, can be encompassed by the invention, so the scope of this invention is not limited to a casino game of races involving horses only. The casino game also encompasses several playable races. In the preferred embodiment, the number of playable races is 84, but any number of races can be included in the game without departing from the scope of the invention.

Figure 1:
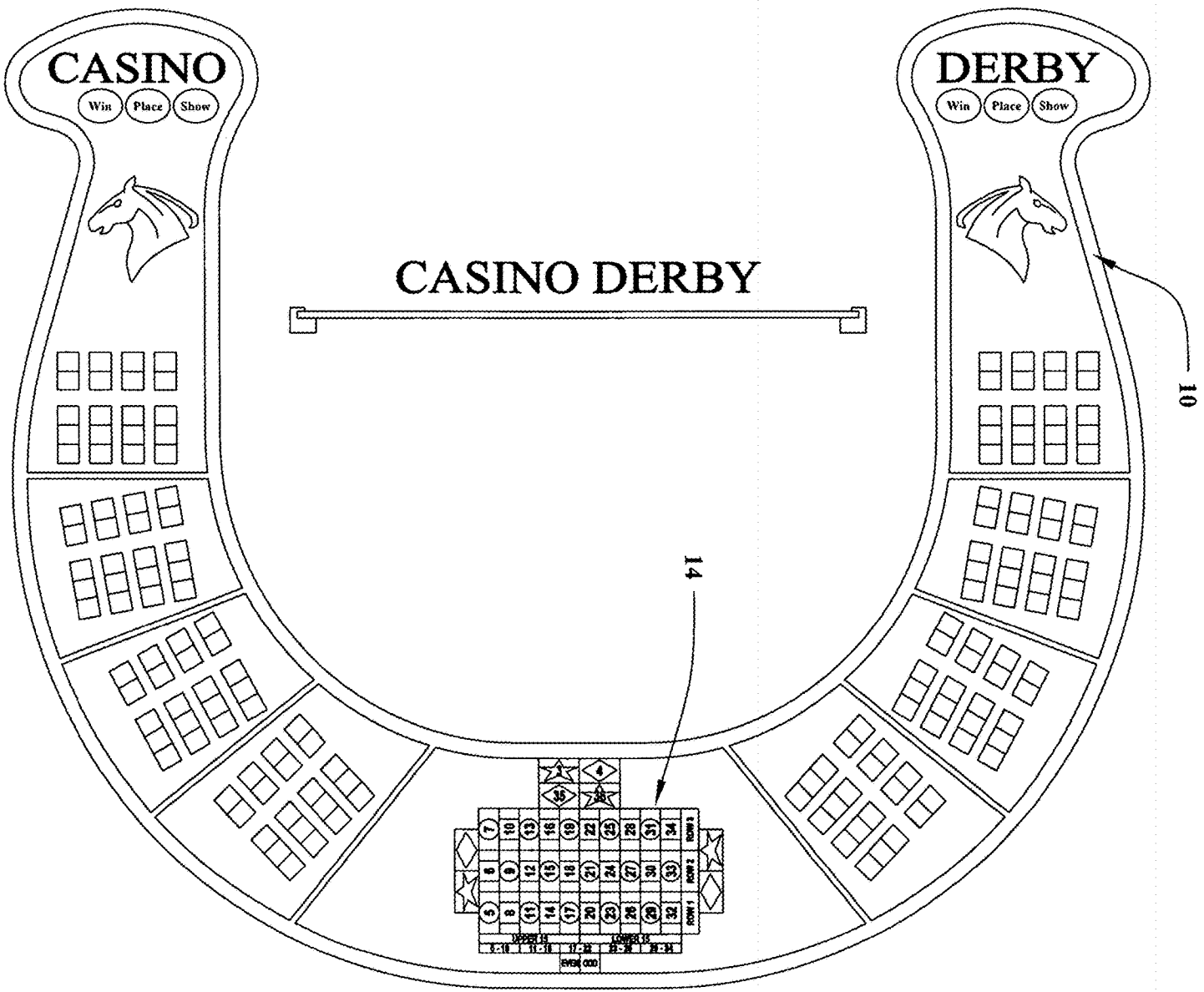
FIG. 1 is a schematic diagram of a horseshoe playing surface of the horse racing casino game in accordance with the present invention.
Figure 2:
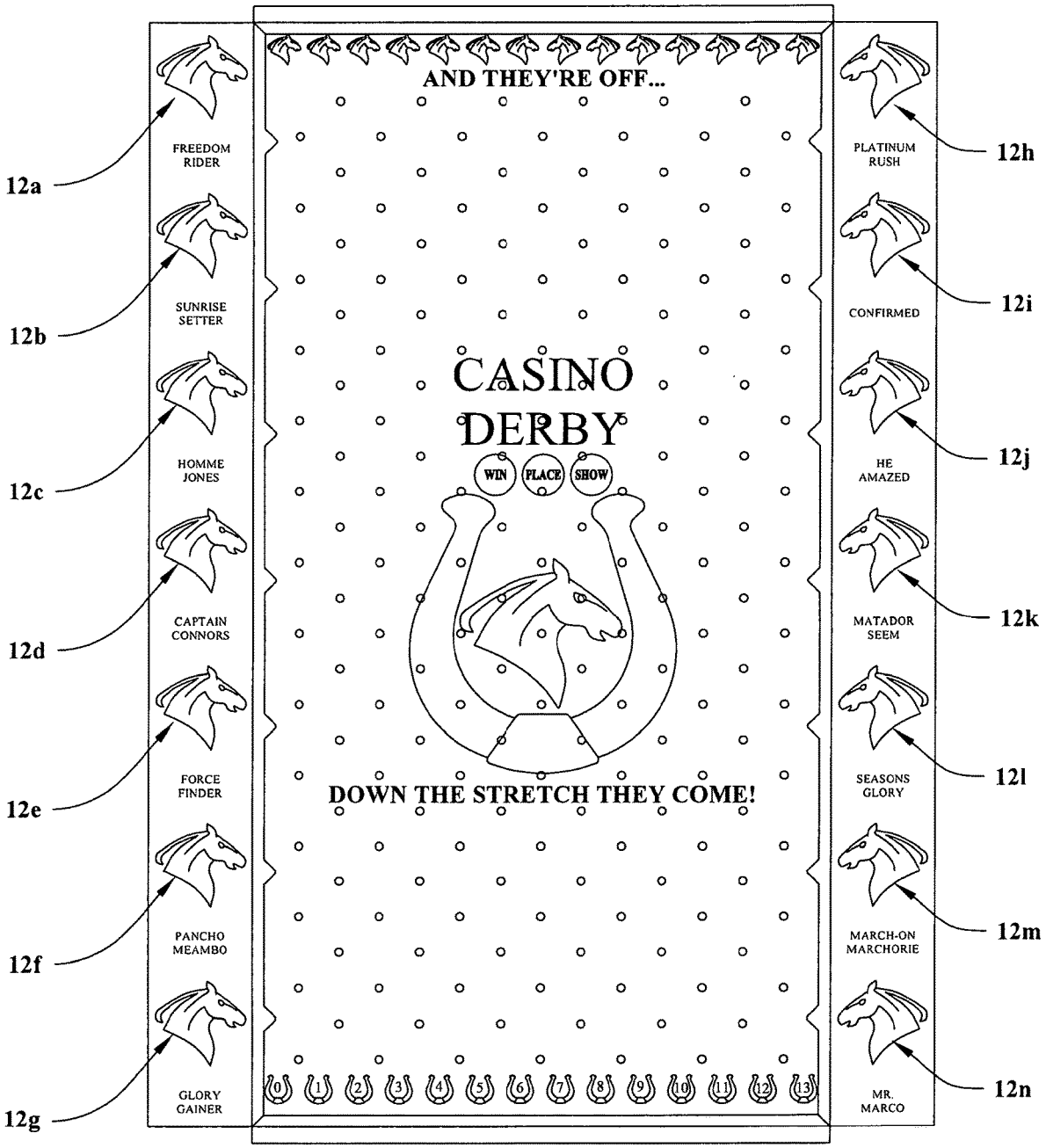
FIG. 2 is a schematic diagram showing horse positions.

Referring now to FIGS. 1 and 2, there is shown a schematic diagram of a horseshoe playing surface of the horse racing casino game in accordance with the present invention. A horseshoe-shaped playing surface 10 is provided, having fourteen horse positions 12*a*-12*n*, in the preferred embodiment, and a betting area 14 for total sum betting, inscribed thereon. The dimensions of the playing surface are approximately 15'×10'. The betting area 14 is shown in enlarged detail in FIG. 3.

The game allows players to bet two ways:

1) on the horses; and 2) via total sum betting.

Figure 4:
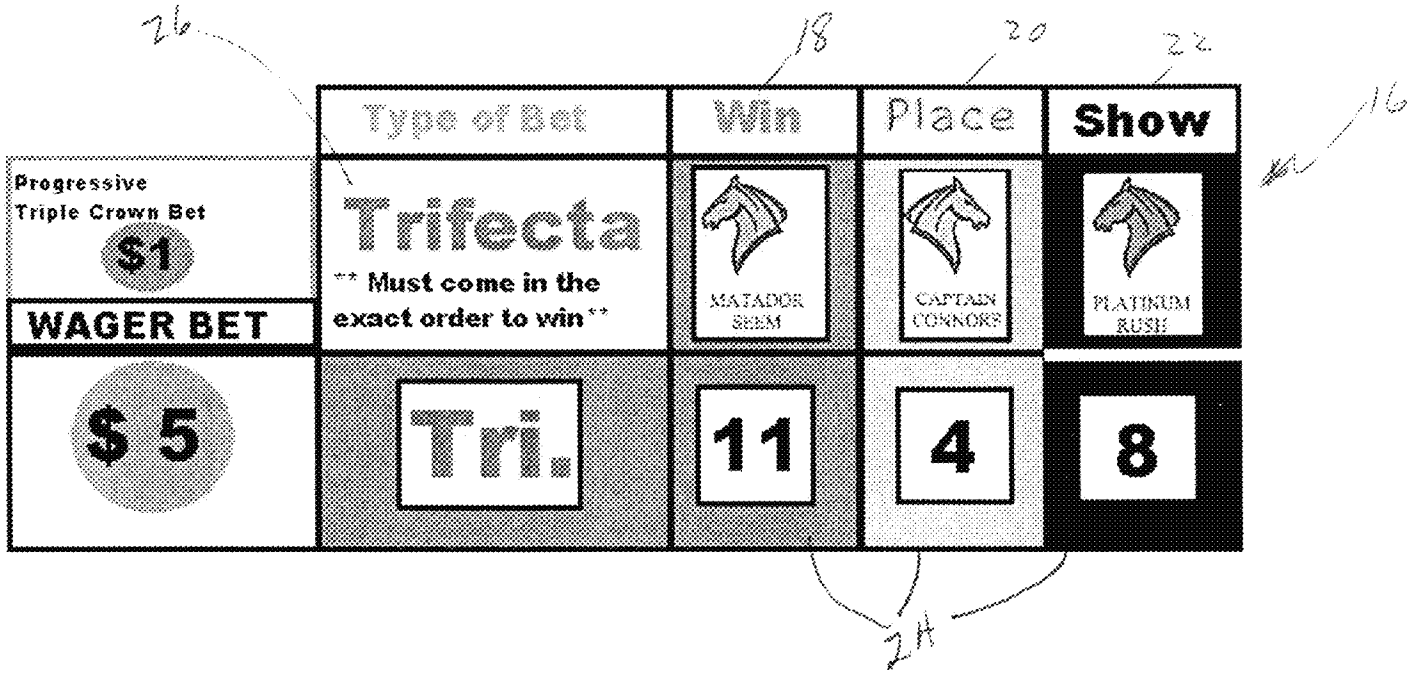
FIG. 4 is a schematic diagram of each horse betting spot available on both sides of the horseshoe playing surface area shown in FIG. 1.

Referring now to FIG. 4, players can bet on fourteen different horses, in the preferred embodiment, by placing a ball or balls, not shown, in the horse betting spot 16 available on both side of the horseshoe surface playing area 10 in the following ways:

1) N=Normal Bet—Player wages for a horse to WIN 18, PLACE 20 and/or SHOW 22.

2) B2=Boxed (two) 24—Player bets on two horses choosing two positions that must come in, but in any order.

3) B3=Boxed (three) 24—Player bets on three horses choosing three positions that must come in, but in any order.

4) Exta.=Exacta Bet—Player chooses two horses that must come in the exact order.

5) Tri.=Trifecta 26—Player chooses three positions that must come in in the exact winning order.

Located in the center of the horseshoe-shaped table playing area 10 is the betting area 14 that provides an opportunity for players to win based on the total sum of the three winning horse positions. The dimensions of the total sum area in the preferred embodiment are 15"×6¾". Of course, other dimensions can be used without departing from the scope of the invention. Example: WIN=6;

PLACE=5; SHOW=12. Total Sum=23.

In the preferred embodiment, 84 different races can be run before the game repeats. The total sum betting feature includes a progressive total pot. That is, when one horse position wins three races in a row, the progressive total is shared among the winners or is won by the single player bet.

Figure 3:
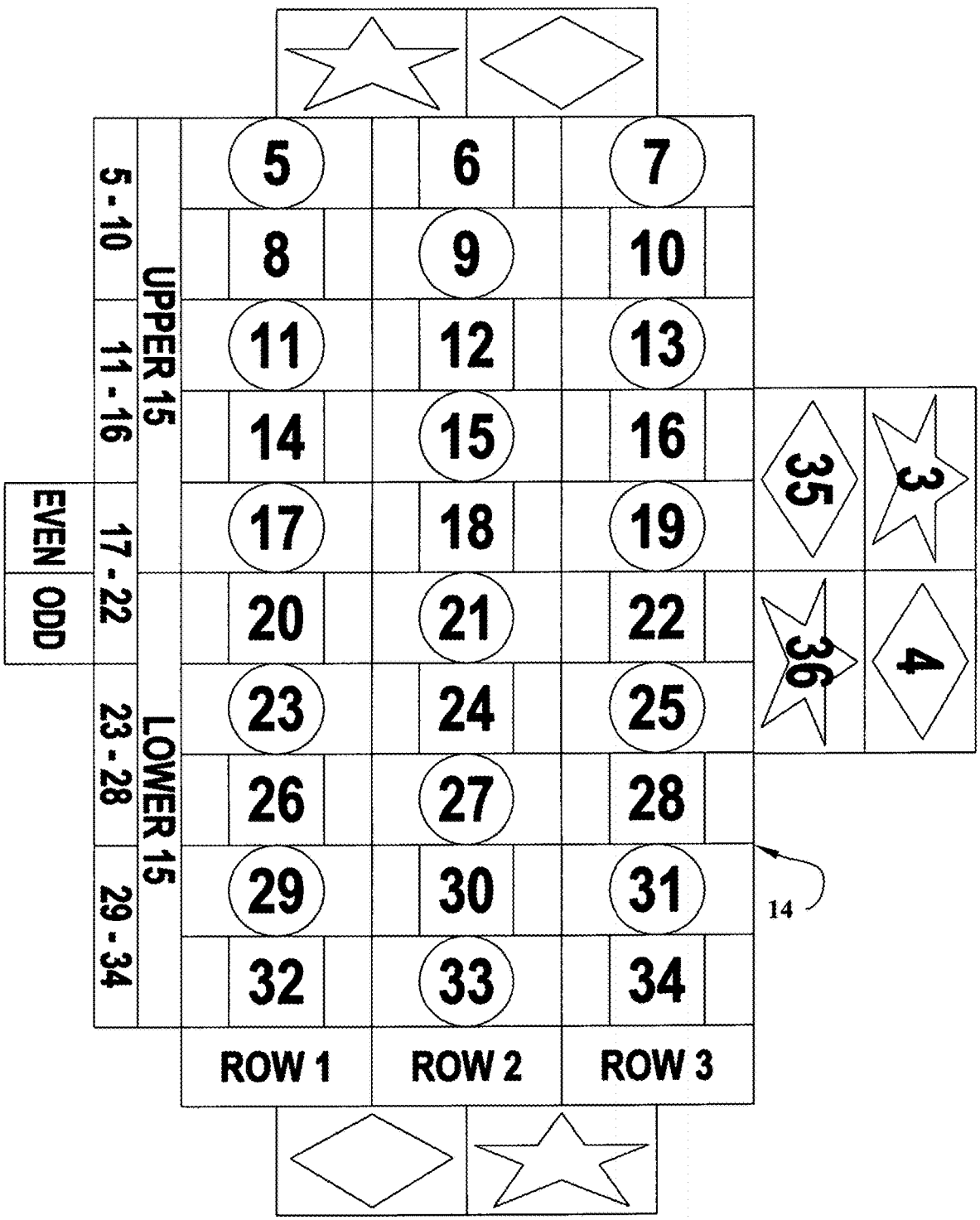
FIG. 3 is an enlarged view of a betting area.
Figure 5:
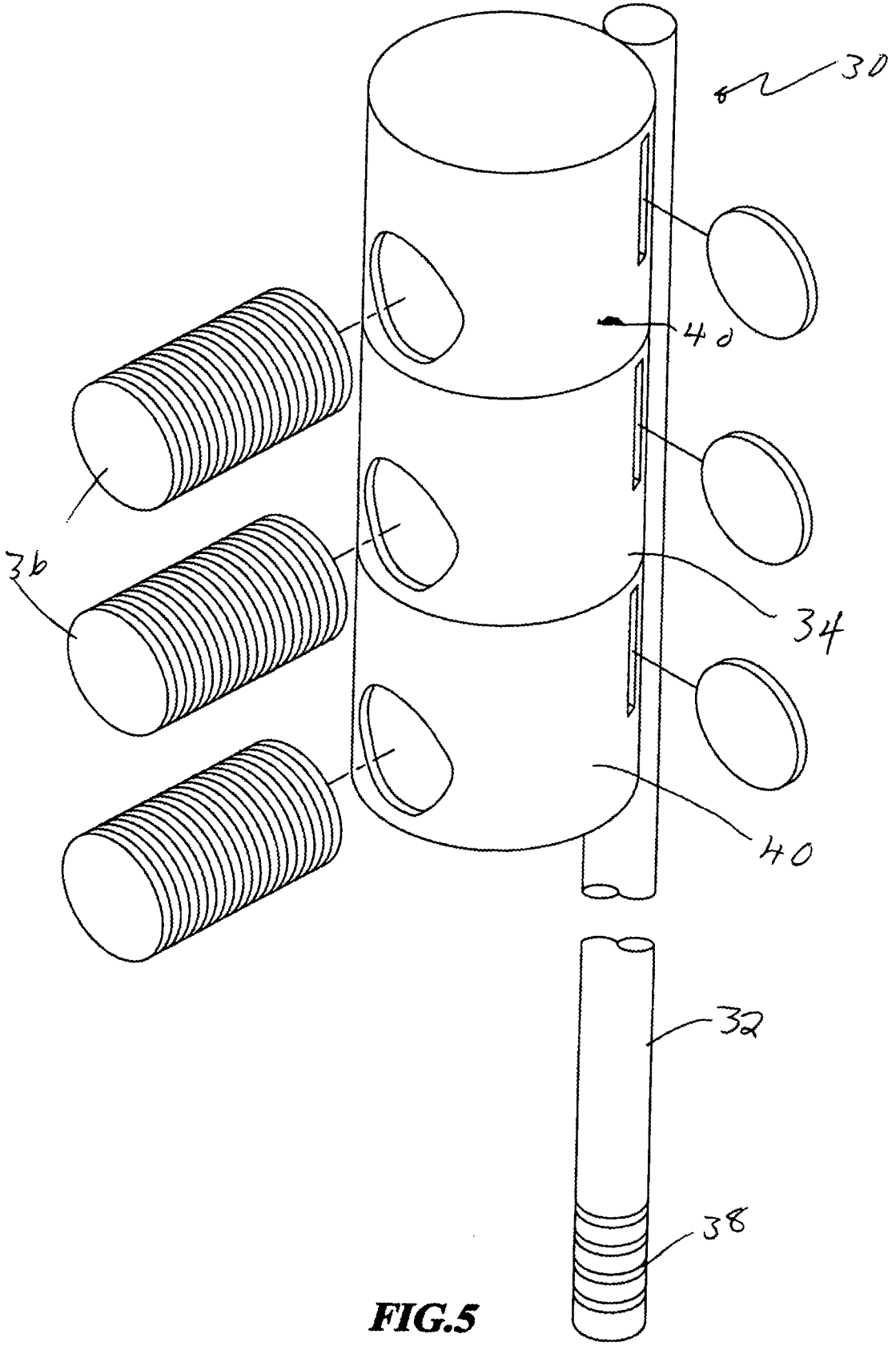
FIG. 5 is a perspective view of a disk loader unit used with an embodiment of the inventive casino game.

Referring now to FIG. 5, there is shown a disk loader unit 30. The unit 30 has a post or stand 32 in the preferred embodiment on which a housing 34 containing disks 36 is rotatably mounted. The lower portion of post 32 has a friction grip 38 for a dealer, not shown, to grasp in order to move disk loader unit 30 into each release row on betting area 14 (FIG. 3).

In operation, a casino dealer lifts post 32, moves it to a predetermined row on betting area 14, and imparts a circular motion to housing 34, rotating housing 34 until friction slows and stops the motion and a WIN, PLACE, or SHOW disk 36 is released from housing 34 and lands on a portion of betting area 14.

Figure 6:
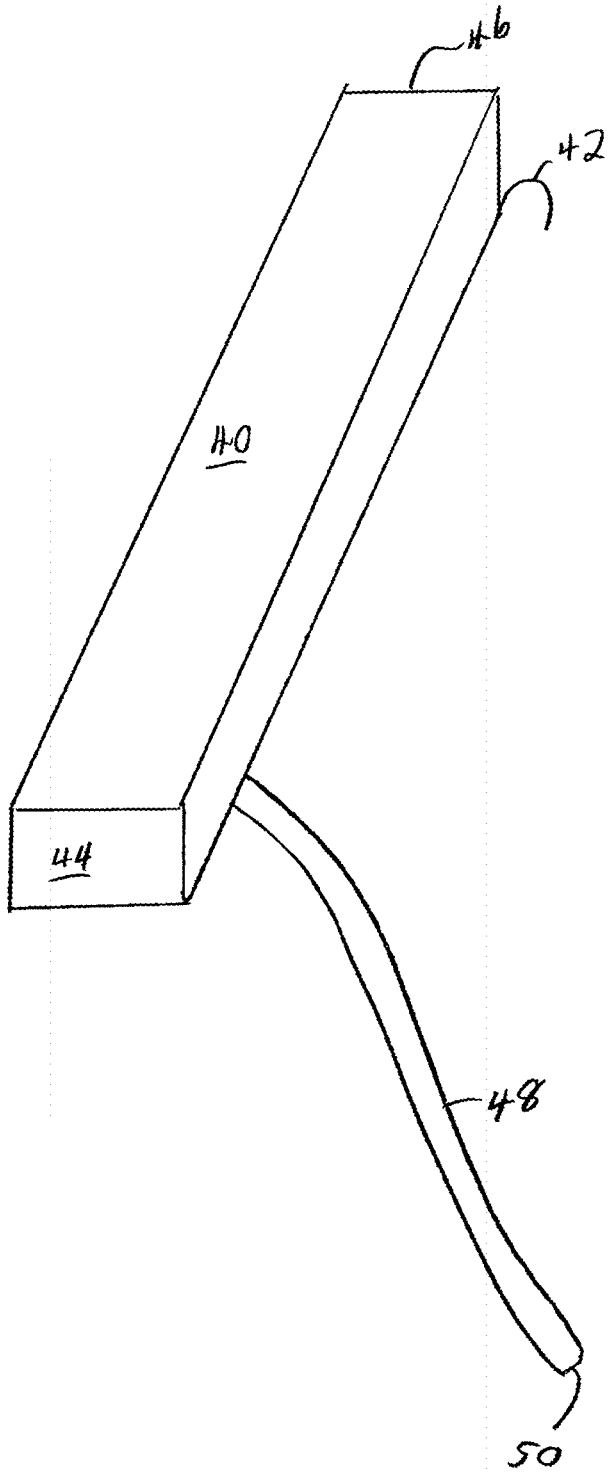
FIG. 6 is a perspective view of a ball loader unit used with the preferred embodiment of the inventive casino game.

Referring now to FIG. 6, there is shown a ball loader unit 40, which is the preferred embodiment of the invention. The unit 40 has a rectangular housing in the preferred embodiment, but it should be understood that other shapes for housing 40 (e.g., cylindrical, polygonal, etc.) can be used without departing from the scope of the invention. The cross section dimensions of ball loader housing 40 are only slightly larger than the diameter of a ball, not shown, so three balls can be loaded seriatim. Connected to housing 40 are mounting hooks 42 (only one of two being shown in FIG. 6) to mount housing to a vertical surface of matrix board, not shown. It should be understood that other means for mounting housing 40 can be used without departing from the scope of the invention. Housing 40 has a closed end 44 and an open end 46, into which balls can be loaded. Extending from housing 40 is a dealer handle 48 with a friction grip for a dealer, not shown, to grasp in order to direct marker balls towards a board having a matrix of pins. Balls are loaded three at a time, one being green, one yellow, and one black.

Green balls represent WIN, yellow balls represent PLACE, and black balls represent SHOW. Of course, balls of other colors or patterns are also considered within the scope of the present invention.

In operation, a casino dealer moves dealer handle 48 to the board having a matrix of pins, and releases three balls 36, one being green (WIN), one yellow (PLACE), and one black (SHOW) from housing 40, the balls 36 landing at the bottom of the board.

There are two main types of bets: Horse Bets and Total Sum Bets in separate betting areas. In the Horse Bets area, regular bets are WIN, PLACE, and SHOW, and Exotic (rare) bets are Exacta, Trifecta, Box 1, and Box 2. The table minimum on the horse racing side is $1.00.

In the Total Sum Bets area, bets can be placed on individual numbers on the table layout, and combo bets on combinations of multiple numbers. Exotic longshot bets are associated with the lowest and highest total sums: 3 through 7, and 32 through 36. Total Sum bets 3, 4, 35, and 36 are in a special wagering area and pay higher odds than the other numbers. The 5, 6, and 7 total sums (both singly and as part of combo bets) pay especially long odds when the drop position is at the opposite end (11, 12, or 13), and similarly 32, 33, and 34 total sums (both singly and as part of combo bets) pay especially long odds from drop positions 0, 1, and 2. The table minimum is $5.00 for "outside" bets and $10.00 for "inside" bets. Table maximum is at the casino's discretion but are set at $100.00 in the preferred embodiment.

Three different methods of offering wagers are treated: Parimutuel, Electronic, and Gaming Table.

1) Parimutuel Method

The Parimutuel wagering method involves all the bets of a given type being placed into a pool. Identical to the way betting works at racetracks, players make their bets at betting windows or electronic kiosks and are given tickets showing the bet made and the amount wagered. The casino or racetrack takes a percentage of the total amount wagered, and the rest is divided proportionately among all the winning tickets. For example, all the money wagered on "SHOW" wagers is dividing among those whose SHOW bets were for horses which finished first, second, or third. The "PLACE" pool is divided among those whose PLACE bets were for horses that finished first or second. The "WIN" pool is divided among those whose WIN bets were for the first place horse. The "Exacta" pool goes to those who chose the first and second horses in the correct order. The "Box 2" pool goes to those who chose the first and second horses in either order. The "Trifecta" pool goes to those who chose the first three horses in the correct order, and the "Box 3" pool goes to those who chose the first three horses in any order.

No math is necessary because the casino's House Edge is fixed in advance. A typical number at racetracks is 14%, meaning 86% of each pool is returned to the players, but in casinos where the expense of running the "race" is less than with real horses, a smaller House Edge may be chosen.

A drawback to Parimutuel betting from the players' point of view is that the odds are not fixed, and can change as more money comes in, so that a bet on a horse that was an underdog at posting time may pay less when the race is finished because a greater proportion of additional money was bet on that horse.

For Total Sum bets, every combination bet on multiple numbers is allocated equally between the numbers, so that the entire pool of money bet is returned to players in proportion to the amount they bet on the winning total number.

2) Electronic Method

The Electronic wagering method involves players making wagers at electronic betting stations or kiosks or on personal devices. It allows exact odds for a given house edge to be calculated for each bet using the mathematical model. The odds payouts are then rounded to give a bet whose House Edge is approximately the desired percentage. There are 14×13×12×8×3=52,416 sets of odds if three House Edges of 6%, 10%, and 14% and the eight drop positions are used with distinct probability distributions.

The difference between the Parimutuel and the Electronic methods, from the casino's point of view, is that the players get guaranteed odds rather than the casino getting a guaranteed profit. The casino's average House Edge will be as it is set. The casino will win money on some races and lose on others, and the very high odds available for some bets will result in high volatility in the profitability of the game, because of the possibility of large payouts when large bets hit at high odds.

3) Gaming Table Method

This method is intermediate in complexity of the odds offered, but it has the advantage that it can be offered without requiring computers to keep track of the amounts wagered and paid in a pari-mutuel system or an electronic system. Players may place bets directly on the gaming table by using betting chips, with different players' bets distinguished by each player at the table having his own unique colored chips, or by having separate betting areas in front of each player, or by players using tickets to record their bets, or by having casino personnel keeping track of the players' table wagers as at a craps table. The preferred embodiment has a 15' wide and 8' deep horseshoe custom-shaped table that can accommodate up to 40 players. Players may indicate their wagers on a "Flip-N-Bet" device.

Because of the requirement for simple fixed odds that can be easily conveyed to the players, there will be a wide variety of House Edges available on different bets, depending on the drop position. In order for the casino to keep a profit, players are required to pay a $1 "Ante" fee in order to receive full odds on their wager. Players who do not pay this fee receive only 30% of the advertised odds if they win their bet. This fee does not increase with larger bets, so that players making the table maximum for each type of wager will have the best odds and the lowest House Edge (or highest Player Edge, because some bets will favor the player over the House at certain times depending on drop position).

The following odds are recommended:

WIN Odds: 11 to 1 for each horse, paying only if the horse wins.

PLACE Odds: 5 to 1 for each horse (which has two ways to win, by finishing first or second) SHOW odds: 3 to 1 for each horse (which has 3 ways to win, by finishing first, second, or third) Box 2 odds: 50 to 1 for each of the 14×13/2=91 possible combinations.

Exacta Odds: 100 to 1 for each of the 14×13=82 possible permutations

Box 3 odds: 150 to 1 for each of the (14×13×12)/6=364 possible combinations.

Trifecta Odds: 900 to 1 for each of the 14×13×12=2184 possible permutations. Total Sum odds: 20 to 1 for sums 5-34 individual numbers, 50 to 1 for 3, 4, 35, 36.

Total Sum Combos: 9 to 1 for 2 numbers, 6 to 1 for 3 numbers, 5 to 1 for 4 numbers.

Drops from the positions at one end are unlikely to result in outcomes at the other end of the board. Therefore, Total Sum Combo odds payouts are multiplied by 5 whenever the drop position is 0, 1, or 2 and the sum is 32, 33, or 34, and whenever the drop position is 11, 12, or 13 and the sum is 5, 6, or 7. For single-number bets, there is a much larger increase, with the odds jumping from 20 to 1 to 500 to 1 when the drop position is at the opposite end.

Sums of 3, 4, 35, and 36 already have different odds because they are not part of the main table layout, and they pay out 900 to 1 if the drop is from one of the far opposite positions, and otherwise pay 50 to 1.

Although there is no Ante Wager for the Total Sum side of the game, the opportunity for bets that are unfavorable to the House and favorable to the player may be reduced by a special feature: when the game is "dealt" from one of the two middle drop positions (Lane 6 and Lane 7), the dealer may shake a die to determine a line on the layout that will be marked to signal an automatic win for the House on all inside wagers. The rule used is as follows:

Dealing from lane 6, die roll is 1-3: House claims line 4 (14-15-16)

Dealing from lane 6, die roll is 4-6: House claims line 5 (17-18-19)

Dealing from lane 7, die roll is 1-3: House claims line 6 (20-21-22)

Dealing from lane 7, die roll is 4-6: House claims line 7 (23-24-25).

The inventive device was tested for 100 different runs in each drop position, with the final positions of the balls recorded in the order in which they were dropped. The data was symmetrized by averaging results from opposite starting positions. The assumption that later balls which land on top of earlier balls fall to the nearest empty slots on the left or right with equal probability (assuming there are empty slots on both sides, otherwise falling into the nearest empty slot) was found to be consistent with the data. Further tests revealed that there was no statistically significant difference between the distributions from drop points 0, 1, 2, and 3 (and, symmetrically, between the distributions from drop points 10, 11, 12, and 13).

This left four different distributions to be modeled: drop points 0-3, 4, 5, and 6 (with the results from 7, 8, 9, and 10-13 being defined from them by reflection across the midpoint). Each distribution was modeled by the best-fit cubic polynomial for the 14 outcome probabilities using the symmetrized sample data. The total sum, exacta, and trifecta probabilities were calculated using the assumption described above about balls bouncing to the left or right of balls below them.

All references throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

It should be understood that although the present invention has been specifically disclosed by preferred embodiments, exemplary embodiments and optional features, modification and variation of the concepts herein disclosed may be resorted to by those skilled in the art, and that such modifications and variations are considered to be within the scope of this invention as defined by the appended claims. The specific embodiments provided herein are examples of useful embodiments of the present invention and it will be apparent to one skilled in the art that the present invention may be carried out using a great number of variations of the devices, device components, and method steps set forth in the present description. As will be obvious to one of skill in the art, methods and devices useful for the present methods can include a great number of optional composition and processing elements and steps.

Whenever a range is given in the specification, for example, a temperature range, a time range, or a composition or concentration range, all intermediate ranges and subranges, as well as all individual values included in the ranges given are intended to be included in the disclosure. It will be understood that any subranges or individual values in a range or subrange that are included in the description herein can be excluded from the claims herein.

All patents and publications mentioned in the specification are indicative of the levels of skill of those skilled in the art to which the invention pertains. References cited herein are incorporated by reference herein in their entirety to indicate the state of the art as of their publication or filing date and it is intended that this information can be employed herein, if needed, to exclude specific embodiments that are in the prior art.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of," and "consisting of" may be replaced with either of the other two terms. The invention illustratively described herein suitably may be practiced in the absence of any element or elements, limitation or limitations which is not specifically disclosed herein.

One of ordinary skill in the art will appreciate that starting materials, biological materials, reagents, synthetic methods, purification methods, analytical methods, assay methods, and biological methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

Since other modifications and changes varied to fit particular operating requirements and environments will be apparent to those skilled in the art, this invention is not considered limited to the example chosen for purposes of this disclosure, and covers all changes and modifications which do not constitute departures from the true spirit and scope of this invention.

Having thus described the invention, what is desired to be protected by Letters Patent is presented in the subsequently appended claims.

What is claimed is:

1. A casino game having a horse-racing theme, wherein the casino game comprises:

three markers;

a marker holding apparatus comprising a top end and a bottom end, wherein there are release points at the top end and 14 final positions at the bottom end, wherein the final positions are numbered 0 through 13, and wherein each final position can hold only one marker; and a horseshoe-shaped playing surface having a plurality of horse positions and a betting area inscribed thereon, the betting area comprising a predetermined location for Win, Place, Show, Exacta, Trifecta and Total Sum, and wherein the betting area further comprises a surface comprising an instance of each of the numbers consisting of three through thirty six;

wherein the Total Sum represents a total value of numbers of final positions, of the 14 final positions, where the three markers land after having fallen from a dealer position at one or more release points of the 14 release points.

2. The casino game having a horse-racing theme in accordance with claim 1, further comprising means for wagering comprising a game without the use of a wheel.

3. The casino game having a horse-racing theme in accordance with claim 1, further comprising position tokens representing at least one creature from a set consisting of: real animals and mythical creatures.

4. The casino game having a horse-racing theme in accordance with claim 1, further comprising a betting area without the use of a wheel.

5. The casino game having a horse-racing theme in accordance with claim 1, wherein the three markers are chosen from a set consisting of: balls and disks.

6. The casino game having a horse-racing theme in accordance with claim 1, wherein the markers are balls, and wherein the casino dame further comprises a ball loader unit for dispensing the three balls substantially simultaneously.

7. The casino game having a horse-racing theme in accordance with claim 1, wherein the casino game comprises a plurality of playable races for horse-styled races.

8. The casino game having a horse-racing theme in accordance with claim 3, wherein a player may bet on horses represented by the respective tokens.

9. The casino game having a horse-racing theme in accordance with claim 1, wherein a player may bet on the Total Sum without the use of a wheel.

10. The casino game having a horse-racing theme in accordance with claim 1, wherein players can bet on up to fourteen different horses, each of the horses having a unique horse position, in one horse racing game.

11. The casino derby game of claim 1, wherein the balls are color coded, and wherein a first ball is a first color that corresponds to WIN, a second ball is a second color that corresponds to PLACE, and a third ball is a third color that corresponds to SHOW, such that positions of the three markers in the final positions of the marker holding apparatus correspond to a first place horse, a second place horse, and a third place horse in a race.

12. A casino game having two games comprising a horse-racing theme and a Total Sum game, the wherein the casino game comprises:

three markers;

a marker holding apparatus comprising a top end and a bottom end, wherein there are release points at the top end and 14 final positions at the bottom end, wherein the final positions are numbered 0 through 13, and wherein each final position can hold only one marker; and a horseshoe-shaped playing surface having a plurality of horse positions and a betting area inscribed thereon, the betting area comprising a predetermined location for Win, Place, Show, Exacta, Trifecta and Total Sum, and wherein the betting area further comprises a surface comprising an instance of each of the numbers consisting of three through thirty six, wherein a player may make bets on the Win, Place, Show, Exacta, Trifecta or Total Sum using the betting area, wherein the Total Sum represents a total value of numbers of final positions, of the 14 final positions, where the three markers land after having fallen from a dealer position at one or more release points of the 14 release points.

13. The casino derby game having a horse-racing theme and a Total Sum game in accordance with claim 12, further comprising means for wagering without the use of a wheel.

14. The casino derby game having a horse-racing theme and a Total Sum game in accordance with claim 12, further comprising position tokens representing at least one subject chosen from a set of creatures consisting of: real animals, and mythical creatures.

15. The casino derby game having a horse-racing theme and a Total Sum game in accordance with claim 12, wherein a structure of the casino derby game has no wheel.

16. The casino game having a horse-racing theme in accordance with claim 12, wherein the markers are chosen from a set consisting of: balls and disks.

17. The casino derby game having a horse-racing theme and a Total Sum game in accordance with claim 12, wherein the markers are balls, and wherein the casino dame further comprises a ball loader unit for dispensing the three balls substantially simultaneously.

18. The casino derby game having a horse-racing theme and a Total Sum game in accordance with claim 12, wherein the casino game comprises a plurality of playable races for horse-styled races.

19. The casino derby game having a horse-racing theme and a Total Sum game in accordance with claim 14, wherein a player may bet on the horses represented by the respective position tokens.

20. The casino derby game of claim 12, wherein the balls are color coded, and wherein a first ball is a first color that corresponds to WIN, a second ball is a second color that corresponds to PLACE, and a third ball is a third color that corresponds to SHOW, such that positions of the three markers in the final positions of the marker holding apparatus correspond to a first place horse, a second place horse, and a third place horse in a race.

* * * * *